US009908769B2

(12) United States Patent
Sugliano Olivera

(10) Patent No.: US 9,908,769 B2
(45) Date of Patent: Mar. 6, 2018

(54) ERGONOMIC BRIDLE FOR EQUINES

(71) Applicant: Gustavo Sugliano Olivera, Atlántida (UY)

(72) Inventor: Gustavo Sugliano Olivera, Atlántida (UY)

( * ) Notice: Subject to any disclaimer, the term of this patent is extended or adjusted under 35 U.S.C. 154(b) by 112 days.

(21) Appl. No.: 14/858,432

(22) Filed: Sep. 18, 2015

(65) Prior Publication Data

US 2017/0081171 A1 Mar. 23, 2017

(51) Int. Cl.
*B68B 1/04* (2006.01)
*B68B 1/06* (2006.01)

(52) U.S. Cl.
CPC . *B68B 1/04* (2013.01); *B68B 1/06* (2013.01)

(58) Field of Classification Search
CPC ..... B68B 1/02; B68B 1/04; B68B 1/06
See application file for complete search history.

(56) References Cited

U.S. PATENT DOCUMENTS 255,395 A * 3/1882 Rorebeck ..... B68B 1/02 54/24
278,988 A * 6/1883 Massey ..... B68B 1/04 54/15
321,957 A * 7/1885 Enoch ..... B68B 1/02 24/132 R
339,996 A * 4/1886 Michaels ..... B68B 1/02 24/182
366,416 A * 7/1887 Martin ..... B68B 1/02 54/85
592,292 A * 10/1897 Johnson ..... B68B 1/02 54/24
734,903 A * 7/1903 Lewis ..... B68B 1/02 54/24
814,835 A * 3/1906 Curtain ..... B68B 1/04 54/13
925,371 A * 6/1909 McClintock ..... B68B 1/02 54/24
925,372 A * 6/1909 McClintock ..... B68B 1/02 54/24
1,138,115 A * 5/1915 Johnson ..... B68B 1/02 54/24
1,148,096 A * 7/1915 Klabo ..... B68B 1/04 54/6.1
1,351,620 A * 8/1920 Canter ..... B68B 1/04 54/6.2

(Continued)

FOREIGN PATENT DOCUMENTS

DE 743068 C * 12/1943 ..... B68B 1/04
DE 202014007203 U1 * 10/2014 ..... B68B 1/04

(Continued)

OTHER PUBLICATIONS

Machine translation of DE 743068 to Reusner, dated Dec. 1943.*

*Primary Examiner* — Kathleen I Alker
(74) *Attorney, Agent, or Firm* — Brown & Michaels, PC

(57) ABSTRACT

Ergonomic bridle for equines composed of a band formed by two lateral pieces joined to the upper bridge and to the frontal bridge; in which the lateral pieces are joined to curved-crescents which incorporate, at the ends thereof, a belt for the joining to the bit; a nasal band which is connected to a throatband formed by two curved belts which are joined to each other at the area of the lower maxilla.

1 Claim, 2 Drawing Sheets

(56) References Cited

U.S. PATENT DOCUMENTS

| | | | | | |
|---|---|---|---|---|---|
| 1,653,382 | A * | 12/1927 | Wiesenfeld | B68B 1/04 | 54/6.1 |
| 1,747,012 | A * | 2/1930 | Johnson | B68B 1/02 | 54/24 |
| 1,751,226 | A * | 3/1930 | Beckwith | B68B 1/02 | 54/24 |
| 1,773,774 | A * | 8/1930 | Carr | A01K 25/00 | 119/832 |
| 1,939,107 | A * | 12/1933 | Crandall | B68B 1/02 | 54/24 |
| 2,055,395 | A * | 9/1936 | Tilburn | B68B 1/06 | 54/6.1 |
| 2,114,178 | A * | 4/1938 | Crandall | B68B 1/02 | 54/24 |
| 4,480,427 | A * | 11/1984 | Conrad | B68B 1/04 | 54/24 |
| 6,553,747 | B1 * | 4/2003 | Texel | B68B 1/06 | 54/6.1 |
| 2006/0156698 | A1 * | 7/2006 | Barnes | B68B 1/02 | 54/24 |
| 2008/0022638 | A1 * | 1/2008 | Sandor | B68B 1/04 | 54/8 |

FOREIGN PATENT DOCUMENTS

| | | | | |
|---|---|---|---|---|
| EP | 2077248 | A1 * | 7/2009 | E68B 1/02 |
| WO | WO 2008004938 | A1 * | 1/2008 | B68B 1/02 |
| WO | WO 2012085761 | A1 * | 6/2012 | B68B 1/02 |

* cited by examiner

ERGONOMIC BRIDLE FOR EQUINES

BACKGROUND OF THE INVENTION

Up to now, there exists one single traditional system for supporting the bits of equines.

The existing traditional design generates various problems which have been hitherto unresolved: hindering the rear vision of the equines, they exert increased pressure in the cervical, trachea and throat areas.

In the prior art, no ergonomic bridle for equines is found having the technical characteristics which are described in the present patent for an invention.

DESCRIPTION OF THE INVENTION

The object of the present invention is to provide a novel ergonomic bridle for equines which provides improved ergonomy, optimizing the anatomic adaptability, providing physical benefits, relieving the cervical movements, the ears, the facial muscles in general and also increasing the visual range.

This novel ergonomic bridle for equines has particular application in the equestrian sector, where, due to the circumstances, it is necessary to provide a bridle with said characteristics.

Ergonomic bridle for equines, essentially composed of a band, said band being formed in turn by lateral pieces connected by means of any joining element to the upper bridge and frontal bridge.

The crescents, which incorporate, at the ends thereof, a belt for the joining to the bit are provided connected to the lateral pieces and by means of any joining element.

A nasal band which is connected to a throatband, said throatband being formed by two curved belts which are joined to each other at the area of the lower maxilla of the equine.

The present invention provides the following advantages:

The band of the bridle gives movement to the ears of the animal by releasing the sixteen muscles which move them, such that the normal development of one of the most important senses of the equine, which is hearing, is achieved which complements the vision which with this new bridle increases the rear and perimetrical perception.

The curved and rigid pieces, due to the particular form thereof are distanced from the eyes, giving a free movement, avoiding the normal discomforts, allowing it to be located in a more comfortable area for the equine, eliminating the hindering sensation in the near peripheral vision and the pressure of the facial nerves.

This novel ergonomic bridle for equines is regulatable in different positions.

BRIEF DESCRIPTION OF THE DRAWING

In order to complement the description and with the aim of aiding a better understanding of the characteristics of the invention, a series of figures accompany the present specification as an integral part of the same, in which the following is represented in an illustrative and non-limiting manner.

PREFERRED EMBODIMENT OF THE INVENTION

Figure 1:
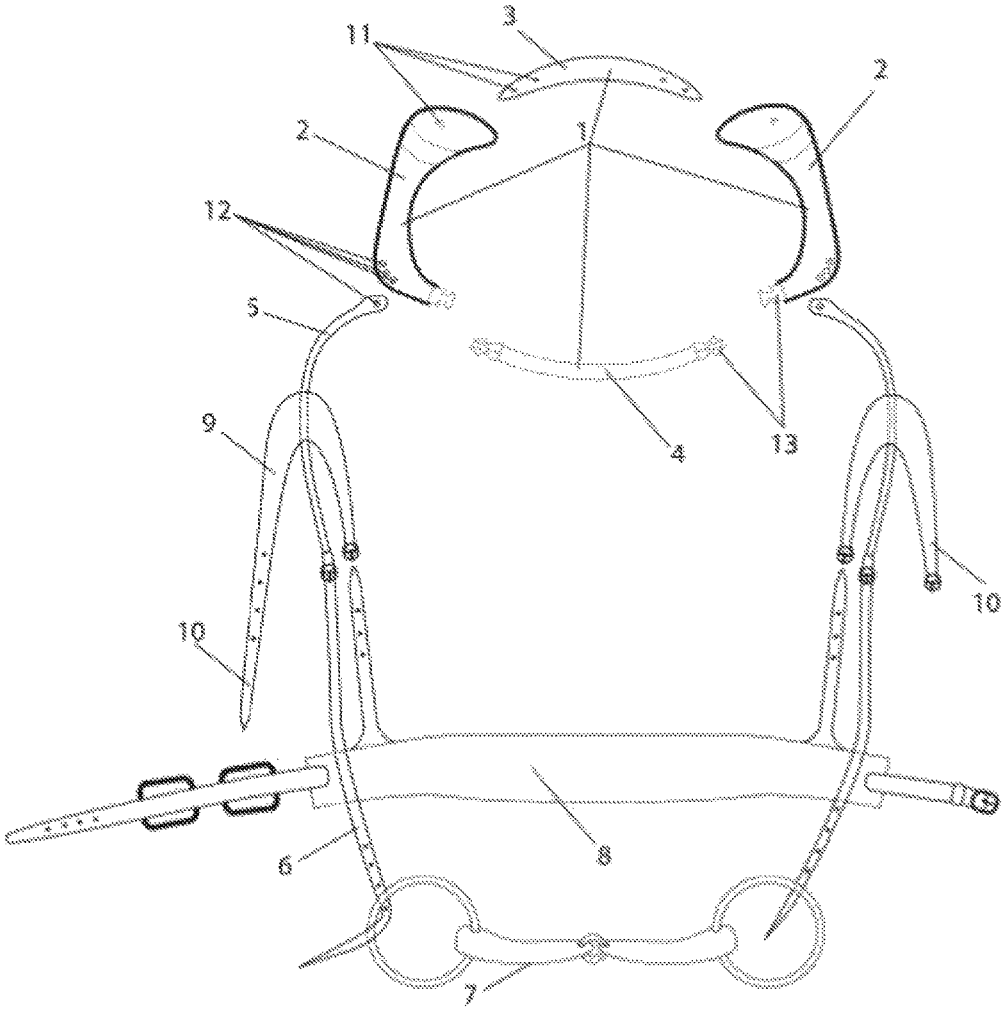
FIG. 1: exploded view of the elements which form the ergonomic bridle for equines.
Figure 2:
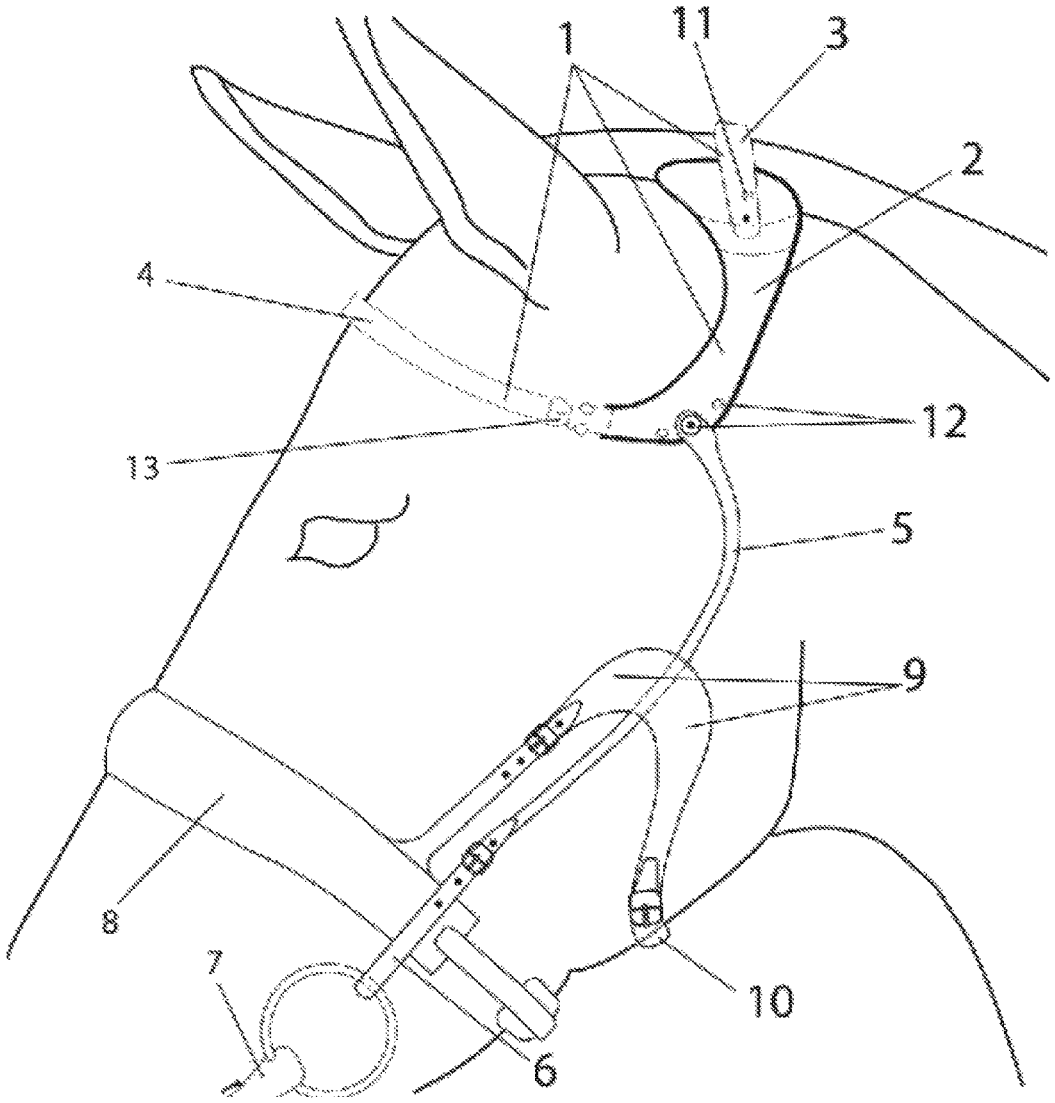
FIG. 2: lateral perspective view of an exemplary use of the ergonomic bridle for equines.

As is possible to observe in the attached figures, the ergonomic bridle for equines is composed of a band (1), said band being formed in turn by lateral pieces (2) connected by means of any joining element (11 and 13) to the upper bridge (3) and frontal bridge (4).

The crescents (5), which incorporate, at the ends thereof, a belt (6) for the joining to the bit (7) are provided, are connected to the lateral pieces (2) and by means of any joining element 12.

A nasal band (8) which is connected to a throatband (9), said throatband being formed by two curved belts (10) which are joined to each other at the area of the lower maxilla of the equine.

With the nature of the present invention as well as a form of putting it into practice having been sufficiently described, it should be added that said invention can undergo variations in form and materials, provided said alterations do not substantially vary the characteristics which are claimed below.

What is claimed is:

1. has been replaced with the following:

An ergonomic bridle for an equine having a head with ears, eyes, a nose and a lower maxilla, the ergonomic bridle comprising:

a band comprising:

two lateral pieces, each lateral piece having first and second opposing ends, configured such that when the bridle is on the head of the equine one lateral piece is on each side of the head of the equine;

an upper bridge having two opposing ends coupled by joining elements to the first ends of the two lateral pieces of the band, and configured such that the upper bridge passes over the head of the equine behind the ears; and a frontal bridge having two opposing ends coupled by joining elements to the second ends of the two lateral pieces of the band, and configured such that the frontal bridge passes over the head of the equine in front of the ears;

two crescents, each crescent having a first end a second end, and a body having a curved shape between the first end and the second end, the first end of each crescent coupled to one of the two lateral pieces of the band by joining elements, the crescents configured such that when the bridle is on the head of the equine a curved portion of the body of each crescent is located further from the eyes and closer to a rear portion of the head of the equine relative to the first and second ends of each crescent;

two belts for attaching a bit, each of the belts having a first end coupled to the second end of one of the two crescents and a second end for attaching to an end of the bit;

a nasal band configured to fasten around the nose of the equine; and a throatband formed by two curved belts, each of the curved belts having a first end coupled to the nasal band and a second end, the second ends of the two curved belts being configured such that when the bridle is on the head of the equine, the second ends of the two curved belts fasten together, securing the throatband around the lower maxilla of the equine.

* * * * *